United States Patent [19]

Ogden

[11] Patent Number: 4,651,380

[45] Date of Patent: Mar. 24, 1987

[54] PORTABLE VACUUM CLEANING MACHINE

[75] Inventor: Stanley D. Ogden, Clovis, Calif.

[73] Assignee: Rug Doctor, Inc., Fresno, Calif.

[21] Appl. No.: 707,088

[22] Filed: Mar. 1, 1985

[51] Int. Cl.[4] ..... A47L 5/00

[52] U.S. Cl. ..... 15/321; 15/326; 15/413; 55/276; 417/366

[58] Field of Search ..... 15/321, 326, 413; 55/276; 417/366

[56] References Cited

U.S. PATENT DOCUMENTS

| | | | |
|---|---|---|---|
| 2,884,185 | 4/1959 | Dolan | 15/413 X |
| 4,068,340 | 1/1978 | Forward | 15/413 X |
| 4,114,231 | 9/1978 | Nauta | 15/321 X |
| 4,231,133 | 11/1980 | Probost | 15/353 X |
| 4,280,245 | 7/1981 | Hiester | 15/326 |
| 4,330,899 | 5/1982 | Miller et al. | 15/413 X |

*Primary Examiner*—Chris K. Moore

*Attorney, Agent, or Firm*—Flehr, Hohbach, Test, Albritton & Herbert

[57] ABSTRACT

A self-contained portable vacuum cleaning machine provides vacuum, hydro-extraction and pressure washing capability and incorporates a vacuum blower head which contains two blowers and (1) is adapted for serial or parallel vacuum blower operation and (2) incorporates a double wall construction which provides cooling air flow for the vacuum motors and defines an exhaust channel for the vacuum blowers which suppresses exhaust noise.

8 Claims, 13 Drawing Figures

PORTABLE VACUUM CLEANING MACHINE

BACKGROUND OF THE INVENTION

This invention relates to vacuum cleaning machines. In particular, the invention relates to a self-contained, portable hydro-vacuum cleaning machine which is configured for quiet operation and which performs all of the following cleaning applications: wet vacuuming, hydro-extraction vacuuming (combined spray cleaning and wet vacuum), and pressure washing. Both the vacuum operation and the pressure operation are dual mode operations.

As used here, "dry vacuuming" involves the application of vacuum suction by an applicator tool to lift dirt and debris from a surface for transfer through a vacuum hose to a temporary storage container. "Wet vacuuming" also involves the use of vacuum pick-up, but in a system which has sufficient suction lift capability and water-tight construction to lift and transfer liquid and debris, typically to a sewer drain or a temporary storage tank. "Hydro-extraction" vacuuming or "steam" cleaning involves the application of a high pressure stream or jet of an aqueous emulsifying solution to a surface and simultaneously or subsequently applying a wet vacuuming operation to pick up and transfer used cleaning solution to a temporary storage tank. State-of-the-art machines mount the cleaning liquid nozzle and the vacuum pick-up head in the same applicator tool to facilitate the hydro-extraction operation. "Pressure washing" typically involves the application of the high pressure cleaning solutions or water to a "gun like" applicator tool having a nozzle and a trigger to activate the high pressure jet of water for cleaning surfaces or machines of grease and foreign matter. As used here, "vacuum unit" refers to the combination of motor and fan/impeller which is used to generate vacuum suction. Also, "vacuum motor" and "vacuum blower" refer to a vacuum unit.

There are available very few portable and self-contained machines which are adapted for multiple functions alone or in combination with dual vacuum operation using series and parallel connection of two or more vacuum motors. Typically, conventional self-contained or portable systems are limited to single function, wet or dry operation, or to dual function capability. This limitation exists because different functions require separate equipment systems which impose prohibitive space and complexity requirements on such units and, particularly in the case of portable units, excessive weight. The space, weight and complexity constraints are even more difficult in high pressure, liquid cleaning operations or high vacuum suction operations or, in particular, in The only built-in self-contained systems known to me which have hydro-extraction and multiple function capabilities are the ACS Model 831 System and the ACS Model 431 System which are available from the Automated Cleaning Systems Division of Rug Doctor, Inc., Fresno, Calif. The ACS Model 431 System is shown in FIG. 1 and is designated by the reference numeral 9, whereas the ACS Model 831 System is shown in FIG. 2 and is designated by the reference numeral 10. The self-contained system 10 includes a central vacuum and pump unit 11, a separate chemical container unit 12 and a separate interceptor filter 13. The totally self-contained system 9 has a chemical container unit and filters which are integrated into the central unit.

Referring further to FIGS. 1 and 2, both the Model 431 System 9 and the Model 831 System 10 use a vacuum/high pressure/electrical conduit system such such 14 which connects the central unit 9 or 10 to individual wall-type outlets 15. Various types of applicator tools 16 can be releasably connected to the outlets 15 via a flexible hose, generally designated 17, for performing various cleaning functions. Despite the relatively small size of the systems 9 and 10—the central unit 11 of 10 is only about 31 inches deep×55 inches wide×48 inches high, whereas the dual vacuum version of system 9 is about 18 inches deep×21 inches wide×52 inches high—these systems are designed to accept different applicator tools 16 and to perform a number of different cleaning functions. These include all of the following functions: (1) central dry vacuum cleaning and dry vacuum extraction (at one or more machine wall outlets 15 simultaneously); (2) wet cleaning and drying (of air conditioning filters, refrigerators, kitchens, etc.); (3) wet cleaning of upholstery, etc.; (4) wet cleaning and instant drying of hard surfaces such as vinyl, concrete or tile floors; (5) hydro-extraction carpet cleaning and (6) hot/cold pressure washing and degreasing.

To implement these functions, central unit 11 of the Model 831 System 10, FIG. 2, contains on-board vacuum suction systems and liquid pumping systems; an automatic metering system for mixing selected concentrated chemical solutions with water; a chemical solution holding tank for temporarily storing the water-chemical mixture prior to application by the high pressure pumping system; and a waste recovery tank. The separate chemical container unit 12 holds a number of containers of concentrated cleaning/treatment solutions which are selected at wall outlets and metered at the central unit 11 for delivery to the on-board holding tank and, then, to the applicator tool 16. The system 10 uses a duplex pump which provides standard pressure of about 350 psi for hydro-vacuum extraction cleaning and 700 psi for pressure washing. A positive displacement vacuum unit provides 215 cfm (cubic feet/min) of air at 180 inches of water lift (in. Hg).

The totally self-contained Model 431 System 9, FIG. 1, contains, on-board, a vacuum suction system, a liquid pumping system, an automatic metering system and a chemical solution holding tank, as does the machine 10, and also a chemical container unit and a wall-type outlet. The machine 9 also includes a modular liquid pumping system which can be readily replaced by a system of different capacity, that is, by a pumping system which provides different pressure ratings and flow rates.

Furthermore, the system 9 is configured to use two or more vacuum units which are connected in series, in parallel or in series-parallel to provide optimized vacuum suction and air flow at the applicator tool 16. The basic vacuum system includes a single horizontal row of two vacuum units. Alternatively, one or more supplemental frame sections, each of which mounts two additional vacuum units, can be mounted in piggy-back fashion on the existing vacuum frame section.

Example of parallel, series and combined series-parallel connections for the Model 831 System 9 are shown respectively in FIGS. 3, 4 and 5 for a four vacuum unit system. The figures schematically illustrate the particular vacuum unit connections to one another and to waste recovery tank 19. For purposes of illustration, it is assumed that each vacuum unit 18 provides air flow of 90 cfm, and 95 inches of water lift (sealed). A parallel connection such as that shown in FIG. 3 maximizes air flow. For the stated vacuum unit capacities, the four-blower parallel arrangement provides 170 cfm air flow and 95 inches of water lift. For buildings which require long vacuum pipe runs, or simply to maximize vacuum suction at somewhat reduced air flow volume, a series connection such as that shown in FIG. 4 can be used. For the stated vacuum unit capacities, the series arrangement of FIG. 4 provides 90 cfm air flow and 180 inches of water lift. Finally, a series-parallel arrangement provides an optimized combination of air flow and water lift/suction. For the stated capacities, the series-parallel arrangement of FIG. 5 provides air flow of about 130 cfm and approximately 160 inches of water lift.

A portable hydro-extraction cleaning machine which is commercially available from Rug Doctor, Inc. of Fresno, Calif. is shown in FIG. 6 and identified by the reference numeral 20. This system 20, which is commercially designated R-150, includes a tank or base 21 which incorporates a chemical solution holding tank, a waste recovery tank and the associated pumps and fittings for providing hydro-extraction operation. Handle 22 is mounted to the base for pushing/pulling the machine 20 on wheels 23 and 24. The drawing also illustrates the location of the vacuum hose connection 25, pressure line connection 26 and a manual dump valve handle 27 which is used to effect manual dumping of the contents of the waste recovery tank.

While the system 20 is not configured to provide dry vacuuming or pressure washing, otherwise the general principles of operation are similar to those of the System 9, FIG. 1, and the System 10, FIG. 2. However, the machine 20 is adapted to use a single vacuum unit or a pair of vertically stacked units which are mounted within the chamber defined in the vacuum exhaust head 28. The optional dual vacuum unit system can be configured in series or in parallel. By way of example, a selectable series/parallel vacuum system for the machine 20 is shown schematically in FIG. 7. The inlet to the fan of the lower unit 29 is indicated at 30, while the outlet pipe 31 thereof is connected to a three-way valve 33 which selectively connects the lower unit 29 (1) to exhaust pipe 34 or (2) to the inlet pipe 32 for the upper unit 29. The upper unit is connected to exhaust pipe 35, which is also shown in FIG. 6. Connections (1) and (2), respectively, provide parallel and series operation of the two vacuum units 29–29.

Referring to FIG. 6, vents or openings 36 are provided on opposite sides of the vacuum chamber of system 20 (only one vent is shown in FIG. 6) to provide a cross-flow of cooling air for the vacuum units within the chamber. For two, 2-horsepower vacuum unit motors, each of which provides about 90 cfm air flow and 120 inches of water lift, series operation provides about 170 inches of water lift and 90 cfm air flow, while parallel operation provides about 109 inches of water lift and 180 cfm air flow.

As suggested by the above description, the machine 20 is versatile and commercially successful, as are the machines 9 and 10. However, like other vacuum systems, quieter operation is desirable, yet can be difficult to achieve. In particular, the exhaust sound level increases considerably when a plurality or multiplicity of vacuum blowers are used. The noise, of course, is particularly loud in the vicinity of the discharge opening of the exhaust pipes which are used in such machines.

FIG. 13 schematically discloses a conventional horn-shaped exhaust system 28 which may benefit from reduced exhaust noise level. In the horizontal sectional view shown in FIG. 8, the vacuum system 28 contains a motor 38 which is exhausted via a generally horn-shaped pipe system 39 of increasing cross-section along the direction from the motor 38 to the outlet in the side of the system 28.

SUMMARY OF THE INVENTION

Objects

Accordingly, it is an object of the present invention to provide an improvement of the above-described portable vacuum cleaning machine which has very quiet operation, yet retains and improves system capability and versatility.

It is also an object of the present invention to provide a vacuum head comprising air flow channels which are designed to suppress noise associated with exhaust air flow.

It is another object of the present invention to provide a vacuum cleaning machine in which the vacuum units are mounted in a vacuum head, which itself comprises exhaust air flow channels which are configured to suppress exhaust noise.

It is still another object of the present invention to provide a vacuum cleaning machine which incorporates a dual-shell exhaust head which is configured to provide a cooling air flow system for the vacuum units and a separate, isolated, exhaust air flow system which suppresses exhaust noise.

SUMMARY

In one aspect, the vacuum cleaning system of the present invention comprises (1) a base which includes both an aqueous solution system which is adapted for applying water or cleaning solution under pressure to an applicator tool, and a waste recovery tank which is adapted for connection to the applicator tool for picking up water and debris; and (2) a vacuum head which is mounted on the base for applying vacuum suction to the applicator tool via the waste recovery tank and is configured as dual, inner and outer shells. The shells form an inner vacuum blower mounting chamber and define an angled exhaust air flow path of increased cross-section for decreasing the velocity and attenuating the noise level associated with the exhaust air flow.

In another aspect, the vacuum head also defines inlet and outlet air flow channels which are separate from the vacuum exhaust channels, for supplying cooling air to the vacuum blower chamber.

In still another aspect of the present invention, two vacuum blowers are used and are inter-connected to provide selectable individual, parallel or series vacuum suction.

BRIEF DESCRIPTION OF THE DRAWINGS

The above and other aspects of the invention are described in detail in the accompanying drawings in which.

DETAILED DESCRIPTION OF THE INVENTION

Overall System Organization

Figure 8:
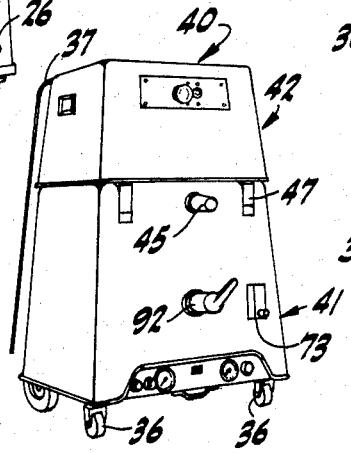
FIG. 8 is a perspective view of the quiet-operation portable vacuum cleaning machine of the present invention.
Figure 13:
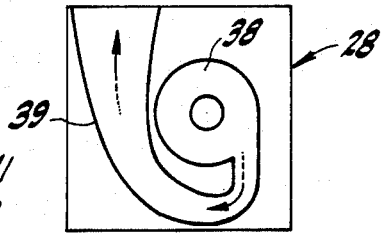
FIG. 13 is a horizontal sectional view of a prior art vacuum system.
Figure 9:
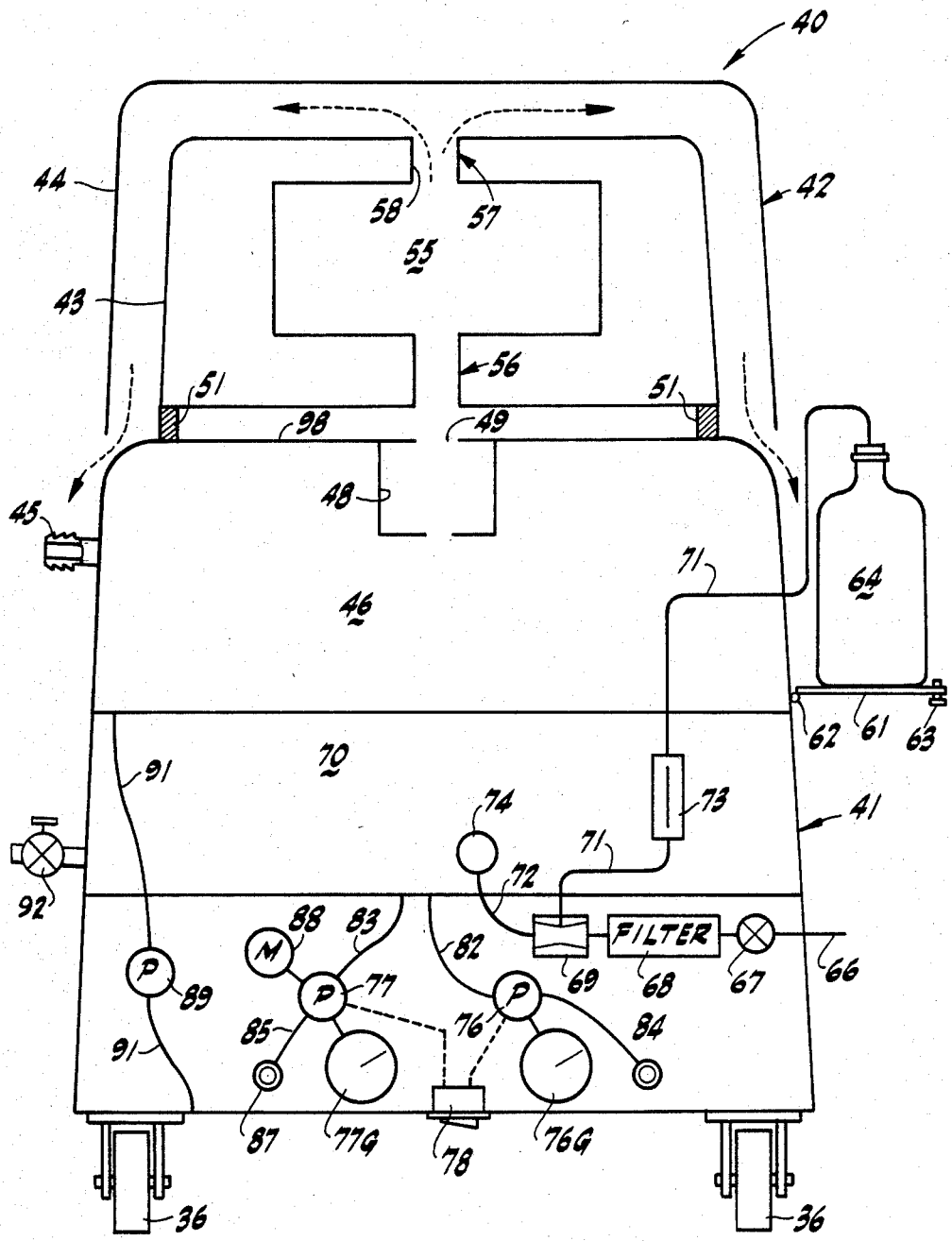
FIG. 9 is an elevational view of the machine of FIG. 8, cut away and in schematic cross-section, to facilitate understanding.

A preferred working model of the portable self-contained cleaning system 40 of the present invention is shown in FIGS. 8 and 9. In FIG. 9, the cover is removed and the system is shown schematically in cross-section to aid understanding. The machine 40 comprises a base or tank 41 and an exhaust head 42. The base or tank 41 is mounted on wheels 36—36 and has handles 37 (FIG. 8) attached to the rear side for moving the machine from one location to another. The head 42 is an assembly, and includes an inner head 43 which is mounted on the base 41, and an outer head 44. The inner and outer heads or shells 43 and 44 are uniquely configured to provide channels between their respective sides which define cooling air channels and exhaust air channels, as described in detail subsequently.

Figure 1:
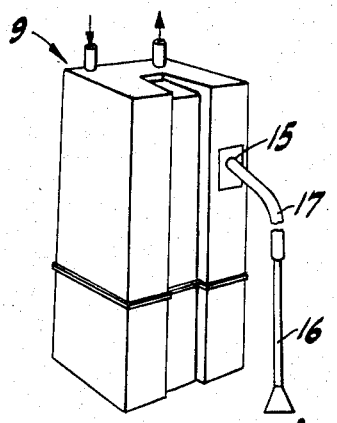
FIG-1 PRIOR ART
FIG. 1 illustrates a prior art, totally self-contained central vacuum cleaning system.
Figure 3:
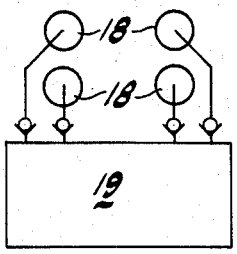
FIGS. 3–5 schematically illustrate parallel, series and series-parallel vacuum connections for the central vacuum cleaning system shown in FIG. 1.
Figure 4:
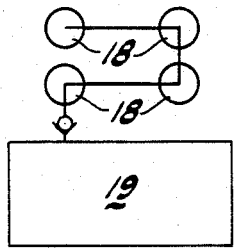
Figure 2:
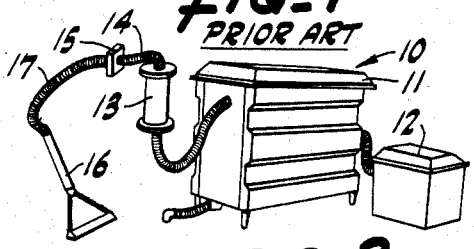
FIG-2 PRIOR ART
FIG. 2 illustrates another prior art central vacuum cleaning system.
Figure 5:
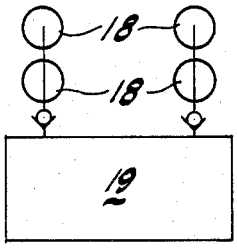
Figure 6:
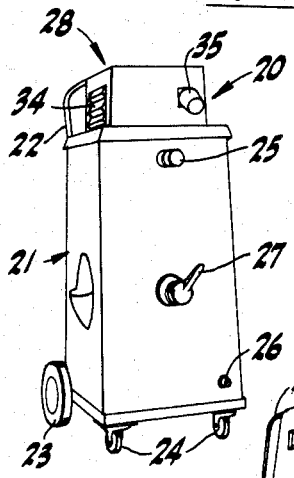
FIG-6 PRIOR ART
FIG. 6 illustrates a prior art portable hydro-extraction vacuum cleaning machine.
Figure 7:
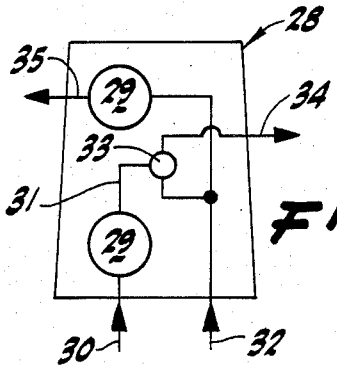
FIG. 7 schematically illustrates a vacuum exhaust connection for the portable system of FIG. 6.

The base 41 contains a vacuum-suction hose connection 45 which couples to a vacuum hose and cleaning tool such as the hose 17 and tool 16 shown in FIGS. 1 and 2. The hose connection 45 is coupled into waste recovery tank 46 which is contained in or, alternatively, formed integrally with, the base 41 for receiving dirt, liquid and debris picked up by the applicator tool 16. The exhaust head 42 is pivotally mounted to the base 41 as by hinges (not shown) and is releasably secured to the base by latches 47—47. The waste recovery tank 46 forms an upper chamber 48 and orifice 49 with respect to the inner head 43 to allow air flow from the tank to the inner head. A gasket or seal 51 between the waste recovery tank 46 and the inner head 43 provides an air-tight seal for efficient vacuum suction operation. A vacuum blower system 55 is mounted within the inner head 43 for applying vacuum pick-up suction via vacuum pipe system 56 through the orifice 49 to the waste recovery tank 46 and from there through the coupling 45 to hose 17 and the tool 16. The vacuum blower system 55 exhaust is routed via exhaust stack system 57 through orifice 58 in the inner head 43 and then through outlet air flow channels formed between the heads 43 and 44 to the ambient.

Pressurized Water/Chemical Solution Supply System

Referring further to FIGS. 8 and 9, and especially to FIG. 9, a bottle support ledge 61 is mounted to the side of base 41 by hinges 62 and is secured to the base by latch 63. Releasing the latch 63 allows the shelf 61 to be pivoted into the horizontal position shown in FIG. 9 for supporting a chemical cleaning solution bottle 64.

Referring further to FIG. 9, the chemical cleaning solution bottle 64 is part of a supply system which supplies aqueous cleaning/treating solution under low or high pressure to the applicator tool 16 for application to rugs, upholstery, curtains, floors, etc. Cleaning solution or water can also be supplied to a separate pressure washing tool for spray cleaning and degreasing applications. In fact, the multiple pressure capability of the machine 40, combined with the vacuum capability and chemical supply system, provides virtually unlimited cleaning and treatment capability, limited only by design of the appropriate applicator tool.

Hot or cold water is supplied under building pressure to the base or tank 41 via inlet line 66 through a manual shut-off valve 67 and through filter 68 and venturi injector 69 into the chemical supply tank 70. The pressurized inlet water flow through the venturi injector 69 injects liquid chemical solution from the bottle 64 over line 71 into the inlet water line 72 and the holding tank 70 at a rate which is determined by a flow meter 73 positioned in the line 71 between the bottle 64 and the venturi injector 69. In the present working model, the manual flow meter 73 meters the chemical solution in the bottle at the rate of 0–6 ounces of chemical solution per gallon of water to provide tank storage of water or of an aqueous cleaning or treating solution. The cleaning solution line 72 is connected to the tank 70 via a conventional float-operated valve 74 which opens and closes as required to maintain the tank at the desired fill level.

The chemical solution in tank 70 is pumped under selected high or low pressure to the applicator tool 16. The selectable low/high pressure capability is provided by a low pressure pump 76 and a high pressure pump 77 which are turned on/off by a double throw rocker switch 78 mounted on the base 41. Line pressure readings are provided by low- and high-pressure gauges 76G and 77G. The low pressure pump 76 and the high pressure pump 77 connect to the chemical storage tank via lines 82 and 83, respectively, and over lines 84 and 85 to associated conventional quick-connect couplings 86 and 87 for supplying water/aqueous cleaning solution from the pump at low or high pressure over the external pressure hose 17 to the applicator tool 16 (FIGS. 1 and 2) or pressure washing tool.

In one working embodiment, the low pressure pump 76 is a unit built pump and motor comprising a diaphragm-type pump, rated at 40 psi at 1.2 gpm (gallons/-min) and an integral permanent magnet motor rated at 1/10 horsepower, 115 VAC, 50/60 Hz. The high pressure pump 77 is an adjustable pressure unit, rated at 50–350 psi at 1.2 gpm and is belt-driven by a separate induction motor 88, which is rated at ½ horsepower, 115 VAC, 60 Hz. In addition to using the low or high pressure pumps for low or high pressure cleaning of carpets, upholstery, etc., the high pressure pump can be used in conjunction with a restricted diameter pressure applicator hose to provide pressure washing at about 500 psi.

As will be appreciated by those skilled in the art, various automatic as well as manual approaches can be used for controlling the inlet and outlet of water/chemical solution to and from the waste recovery tank and the chemical solution tank. In a present working embodiment, the vacuum machine base 41 contains a discharge pump 89 which is connected into the lines of the vacuum system for constantly discharging the waste recovery tank via a discharge line 91 into a sewer line or other waste receptacle during vacuum operation. The waste recovery tank 46 can also be manually emptied using a handle 92 (FIG. 8) of a manual dump valve (not shown). Alternatively, the discharge pump 89 could be controlled by high and low level waste recovery tank switches for automatically discharging water from the tank into a sewer line or other waste receptacle and for automatically terminating vacuum blower operation during the dumping operation if desired. Also, a water level-controlled switch such as a float-controlled switch in the chamber 48 can be used to terminate vacuum operation at a preset water level.

The fill control for the chemical solution tank 70 is described above. Alternatively, high- and low-level switches could be incorporated into the tank 70 to control the inlet of water/chemical solution and to automatically cut off the pumps 76 and 77 when the liquid level is low.

Vacuum Head

Figure 10:
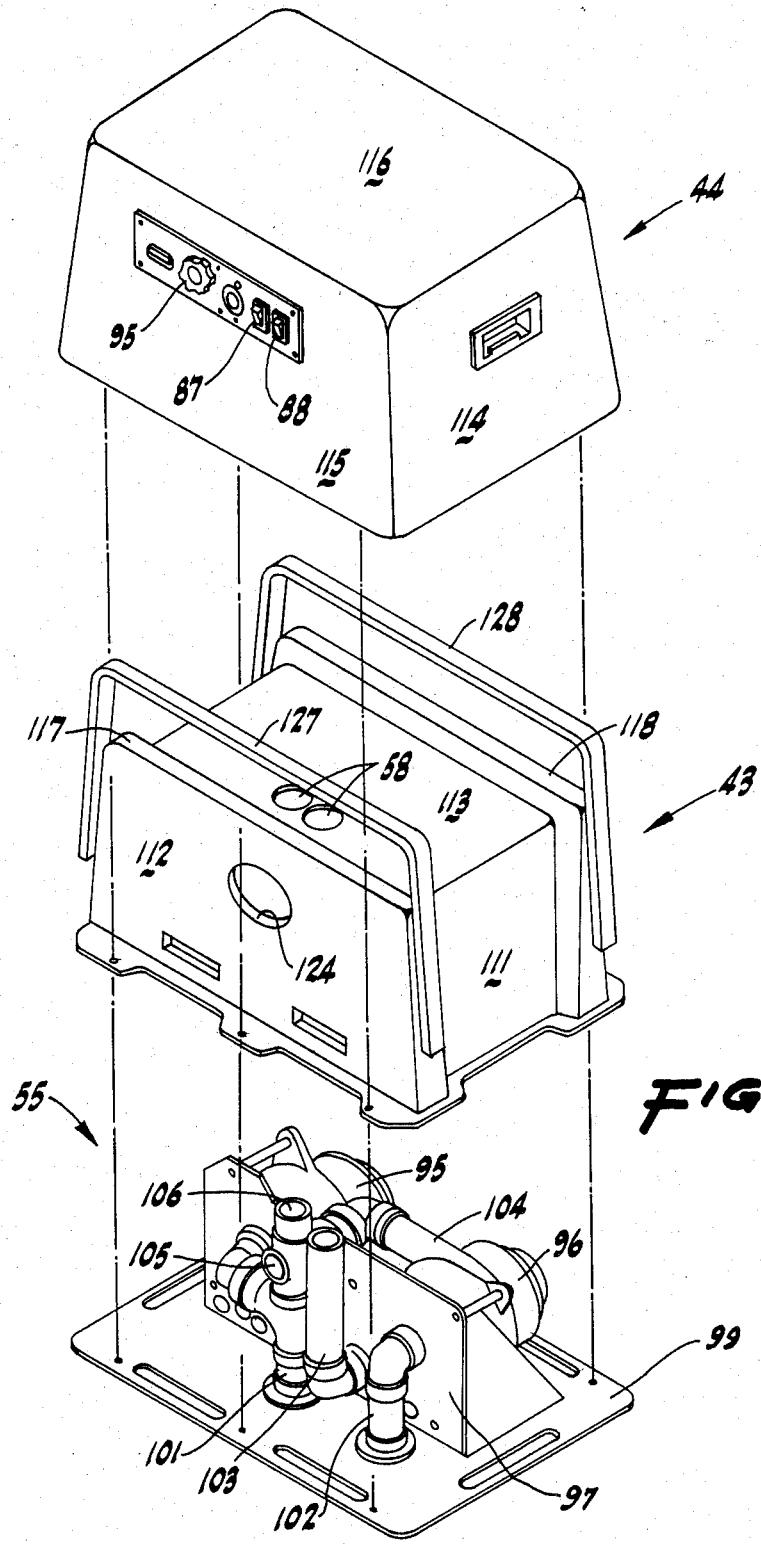
FIG. 10 is an exploded assembly view of the vacuum head of the portable vacuum cleaning machine shown in FIG. 8.
Figure 11:
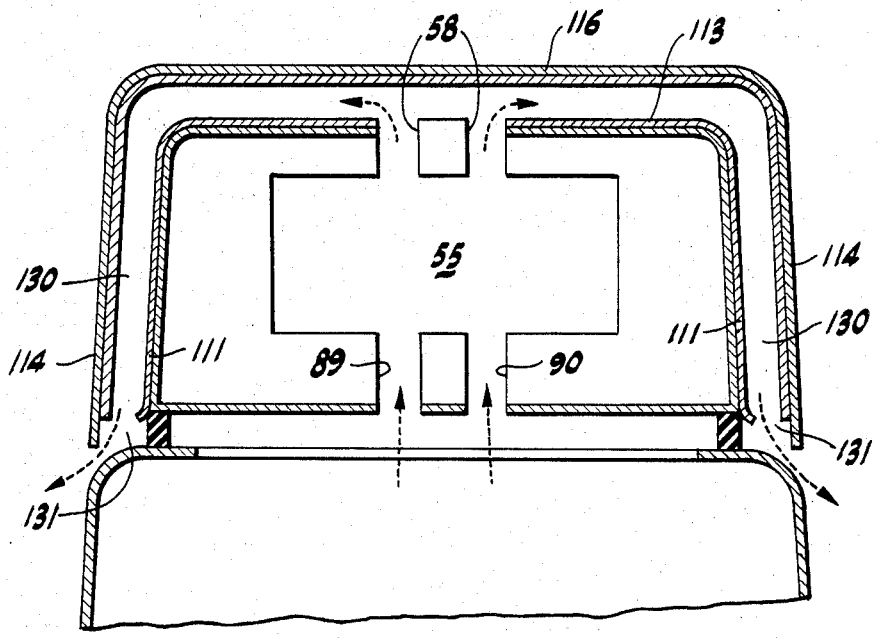
FIGS. 11 and 12 are cross-sectional views, partially in schematic form, of the vacuum head taken in the direction of the arrows 11—11 and 12—12 in FIG. 8.
Figure 12:
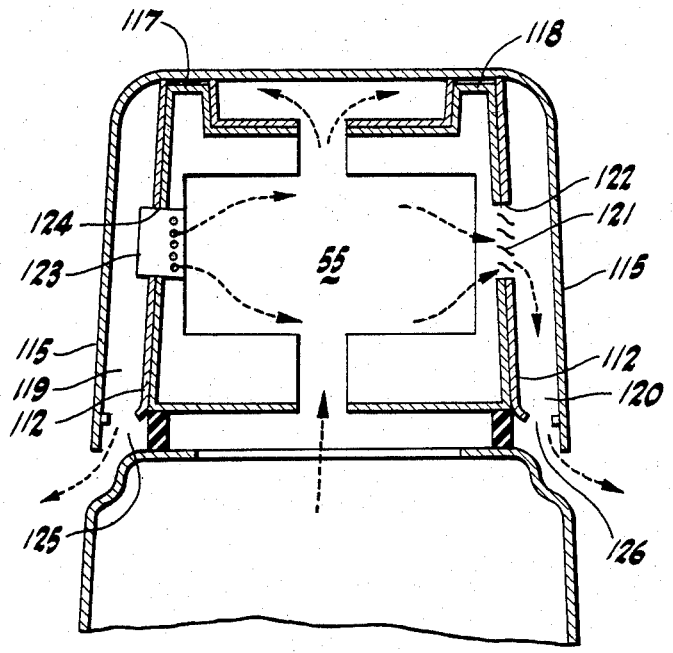

The vacuum exhaust head 42 and the vacuum exhaust system 55 are shown in detail in FIGS. 10–12. Referring initially to the exploded assembly view of a preferred series/parallel embodiment of the vacuum exhaust system 55 shown in FIG. 10, that system includes two vacuum units 95 and 96 (each of which is a motor-driven high speed rotary blower). The units 95 and 96 are mounted on a vertical mounting plate 97 attached to a horizontal mounting plate 99 which is in turn attached to the top surface 98 (FIG. 9) of the machine base 41. The electrical circuits of the vacuum units are connected to individual rocker switches 87 and 88 which are mounted on the front panel of the exhaust head 42 and control the on/off operation of the units. The previously mentioned inlet system 56 (FIG. 9) comprises a pair of pipes 101 and 102 which are connected at one end to the inlet end of the vacuum units 95 and 96 and at the other end to the chamber 48 defined between the waste recovery tank 46 and the mounting plate 99. The exhaust side of the first vacuum unit 95 is connected to a first exhaust pipe or stack 103. The exhaust side of the second vacuum unit 96 is connected by a vacuum pipe 104 into the inlet side of a conventional diverter valve 105. The two outlet sides of the valve 105 are connected, respectively, to the inlet stack 101 for the first blower and to exhaust stack 106 for the second blower. The valve setting is controlled by two position valve 105 controlled by knob 95. Thus, the valve 105 selectively switches or diverts the exhaust flow path of the second vacuum blower 96 (1) into the inlet 101 of the first vacuum blower 95 to provide series-connected vacuum suction, or (2) into the second exhaust stack 106 to provide parallel vacuum suction. As a consequence of this arrangement, the vacuum units can be operated individually, in series, or in parallel. Typical values for water lift in inches of mercury (sealed) and air flow in cubic feet per minute using a two-inch diameter exhaust discharge are:

| Individual | Water Lift (in. $H_g$) | Air Flow (cfm) |
|---|---|---|
| Series | 170 | 90 |
| Parallel | 125 | 180 |

Referring now to the orthogonal cross-sectional views of the exhaust head assembly shown in FIGS. 11 and 12, in addition to FIG. 10, the exhaust head 42 is uniquely configured as exhaust air flow channels which provide very quiet exhaust operation, and as separate, isolated air flow channels for cooling the vacuum motors. Referring to FIGS. 10 and 11, the inner head or housing 43 comprises a unit, formed from opposite sides 111—111 and 112—112 and top 113, which is mounted to the base plate 99. The outer head 44 comprises a shell, formed from opposite sides 114—114 and 115—115 and top 116, which forms a cover or shroud over the inner head. The inner head 43 has ribs 117 and 118 which are covered with a layer 127 and 128 of insulation to provide a sealed support for the outer shell 44. As perhaps shown most clearly in FIG. 12, the resulting sealed, spaced mounting of the outer shell 44 on inner head or shell 43 defines an isolated cooling air inlet channel 119 between one pair of sides 112 and 115, and an isolated exhaust channel 120 defined between the sides 112 and 115 on the opposite side of the housing. Exhaust vent 121 is mounted in an orifice 122 of the exhaust face 112, while cooling air intake fan 123 is mounted in orifice 124 in the inlet face 112 to cooperatively provide cooling air flow through air intake 125 and intake channel 119, through orifice 124/motor 123, over the vacuum units 95 and 96, out vent 121, and through exhaust channel 120 and air outlet 126 to the ambient.

Referring now to FIGS. 10 and 11, the ribbed sides 111—111 and top 113 of the inner housing 43 define, in cooperation with the corresponding sides 114—114 and top 116 of the outer housing 44, a continuous air flow channel which provides vacuum air exhaust flow paths from the exhaust outlets 58 through channels 130 and exhaust outlets 131 to the ambient. Each channel 130 bends approximately 90° in traversing from the top of the housing to the sides thereof. In combination with one-half inch thick layers of sound isolation materials such as unicellular flexible foam formed on the inner top and bottom shell walls which form the channel 130, and primarily as the result of the angled air flow path provided by channels 130 and the abruptly expanded cross-section of the air flow path provided by channels 130 relative to exhaust pipes of the vacuum blowers, the channels 130 provide very quiet exhaust operation. This is demonstrated in Tables 1 and 2.

Table 1 summarizes the sound levels associated with the operation of the present vacuum cleaning machine 40 and the machine 20. The test was designed to measure the sound levels associated, respectively, with the operation of a standard uninsulated R-150 portable vacuum cleaning machine 20 and a VH-175 portable vacuum cleaning machine 40 having the standard exhaust system. This system includes the above-described sound insulation on the exhaust channel side of both the inner and outer shells. Tests were performed both for two motors operating in parallel and for a single motor. Sound level measurements were taken using a Radio Shack Model 42-3019 Sound Level Meter at a distance of 24 inches above the floor and 36 inches from each side—front, right, back and left—of the tested machines.

The results summarized in Table 1 indicate the insulated, angled dual-shell machine 40 was much quieter than the machine 20. That is, the present vacuum cleaning machine 40 provided a 15–18 db noise reduction compared to the prior machine 20.

TABLE 1

| | (Sys 40 vs. Sys 20; Indoor) | | | |
|---|---|---|---|---|
| | Parallel (2 Motors) | | One Motor | |
| Meter Location | Sys 40 | Sys 20 | Sys 40 | Sys 20 |
| Front | 76 dB | 94 dB | 75 dB | 93 dB |
| Right | 79 | 94 | 76 | 92 |
| Back | 76 | 94 | 72 | 91 |
| Left | 78 | 94 | 74 | 92 |

Table 2 is a comparison of data for sound level tests for (1) a standard vacuum cleaning machine 40, that is, a machine which is constructed in accordance with the present invention, and (2) an otherwise standard machine 40 having an uninsulated head 42 without the outer shell 44. This latter machine (2) provides similar sound levels to the prior art machine 20. Therefore, whatever sound level reduction is provided by the data for the two different head arrangements should be the result of the particular dual shell configuration which is associated with the present invention.

The testing was done outdoors to eliminate any variation caused by machine placement in an enclosed room. The data for parallel and series test were taken in the same manner as described relative to Table 1. As shown in Table 2, the dual shell configuration reduced noise levels by about 4 to 9.5 decibels. The associated percentage noise reduction is about 25 percent (4 decibels) to 48 percent (9.5 decibels).

TABLE 2

| | (With & Without Dual Shell; Outdoor) | | | | | |
|---|---|---|---|---|---|---|
| | Parallel | | | Series | | |
| Meter Location | Sys. 40 | W/O Dual Shell | Noise Reduction | Sys. 40 | W/O Dual Shell | Noise Reduction |
| Front | 78.5 dB | 88 dB | 9.5 dB | 78.5 dB | 87 dB | 85 dB |
| Right | 82 | 86 | 4 | 81 | 86 | 5 |
| Back | 83 | 90 | 7 | 82.5 | 89 | 6.5 |
| Left | 80.5 | 87 | 6.5 | 80 | 86 | 6 |

The vacuum operation described above for the vacuum cleaning machine of the present invention can be used alone or in combination with the above-described pressure fluid operation for hydro-extraction or vacuuming. Also, the pressure fluid operation can be used alone for spray or pressure washing.

Having thus described a preferred working embodiment and various alternative aspects of the present vacuum cleaning machine, it is contemplated that those of usual skill in the art will modify the elements in a manner which is within the scope of the present invention, as defined by the following claims.

What is claimed is:

1. A vacuum pick-up system, comprising:

a vacuum pump unit having a vacuum suction inlet and an exhaust outlet;

a vacuum recovery tank having an inlet for receiving external materials under vacuum suction and an outlet connected to the vacuum pump inlet for applying vacuum suction to the tank; and a vacuum head comprising (A) a housing mounted on the recovery tank and defining an enclosure for the vacuum pump, and (B) a shell mounted over the housing, said shell and housing cooperatively defining a pair of mutually isolated air flow channels therebetween, a first of the channels being coupled to the vacuum pump outlet and defining an air flow exhust path containing a sharply-angled bend for exhausting the vacuum pump to the ambient, the angle being selected to minimize turbulence and thereby control noise, and the second of the channels including the interior of the vacuum motor enclosure for providing a path for cooling-air flow from the amblance across the vacuum motor and back to the ambience.

2. A vacuum pick-up system, comprising:

a vacuum pump unit having a vacuum suction inlet and an exhaust outlet;

a vacuum recovery tank having an inlet for receiving external material under vacuum suction, and an outlet connected to the vacuum pump inlet for providing the vacuum suction;

a vacuum head comprising (A) a housing having four sides and a top mounted on the recovery tank and defining an enclosure for the vacuum pump, the first and second, opposite sides thereof having respective openings for the inlet and exhaust of cooling air to and from the pump enclosure, and (B) an outer shroud cooperatively defining (1) with the first and second opposite housing sides, first and second inlet and outlet channels for providing cooling air to flow through the head and from the motor enclosure; and (2) with the third and fourth and the top sides of the housing, a pair of vacuum pump exhaust channels having approximately 90° bends therein and being connected to the exhaust outlet of the vacuum pump for exhausting the vacuum pump and decreasing the sound level of the exhaust air flow.

3. A vacuum pick-up machine, comprising:

(A) a vacuum recovery tank having an intake for receiving internal materials and an outlet;

(B) vacuum motor means for providing pick-up suction;

(C) a vacuum head mounted on the vacuum recovery tank for applying pick-up suction from the vacuum motor means to the recovery tank; the vacuum head comprising:

(1) an inner compartment having (a) four sides, (b) a top surface, and (c) a vacuum pipe means having first and second opposite ends, the first end of said pipe means connecting the vacuum motor means to the recovery tank outlet, and first and second opposite sides of said inner compartment having respective openings for providing an intake and an outlet for a cooling-air flow-path across the vacuum motor means;

(2) an outer shroud comprising (a) four sides, and (b) a top surface, (c) the four sides cooperatively defining with the corresponding sides of the inner compartment four mutually isolated channels having openings toward the bottom thereof, (d) first and second ones of the channels being defined between first and second opposite shroud sides and the corresponding first and second, opposite compartment sides for providing a cooling-air flow path via the intake and outlet openings across the vacuum motor means, (e) the top surface of the shroud defining with the top surface of the inner compartment an exhaust chamber, said chamber being connected to the second end of the exhaust pipe and (f) third and fourth ones of the channels being defined between third and fourth opposite shroud sides and the third and fourth, opposite compartment sides and communicating with the exhaust chamber for completing a vacuum exhaust air path from the recovery tank through the vacuum motor means to the exhaust chamber via the exhaust pipe, and from the exhaust chamber through the third and fourth channels to the ambient; and wherein (D) the exhaust chamber defines a flow path oriented at an angle of about 90° with respect to the third and fourth channels for decreasing the sound level of the vacuum exhaust air path.

4. A vacuum pick-up machine comprising:

a vacuum recovery tank having an intake for receiving external materials under vacuum pick-up suction; and a vacuum head mounted on the vacuum recovery tank and including a vacuum unit for applying vacuum pick-up suction to the vacuum recovery tank;

the vacuum head comprising an inner compartment and an outer shell; and wherein the compartment comprises four opposite sides and top and bottom sides and is adapted for mounting the vacuum motor means and connecting the vacuum motor means to the vacuum recovery tank, the compartment further comprising cooling air inlet and exhaust openings in first and second sides thereof for permitting cooling air flow across the vacuum motor means, and having a raised edge along the upper end of each of the first and second sides for defining a vacuum air exhaust chamber in the top side thereof opening to the third and fourth sides thereof;

the outer shell comprises four opposite sides, and a top side configured for seating on said raised edges and fitting over and substantially covering the inner compartment and defining four mutually isolated air flow channels with respect to the corresponding four compartment sides, the first and second channels being associated with respective first and second, opposite compartment sides for providing an intake channel and an exhaust channel for providing a cooling air flow path across the vacuum source means, and the top side enclosing the exhaust chamber; and said exhaust chamber being connected to the vacuum motor means outlet for directing air flow from the recovery tank through the vacuum motor means and through the exhaust chamber out third and fourth side channels associated with the respective third and fourth compartment sides, the exhaust chamber and third and fourth channels being configured to provide an approximately 90° change in air flow direction and to provide an abrupt increase in the cross-section of the air flow path relative to that provided by the vacuum motor means outlet, for controlling the sound level of the exhaust air flow.

5. The machine of claims 3 or 4 wherein the vacuum system comprises a pair of vacuum units which are interconnected to provide selectable parallel or series vacuum suction operation.

6. The machine of claims 3 or 4 wherein the vacuum system comprises a pair of vacuum units, each having an inlet and an exhaust; the exhaust of the first vacuum unit defining a first exhaust air flow path coupled into the inlet of the second vacuum unit, and also defining a second exhaust air flow path; and, means for directing the exhaust air flow of the first vacuum unit into the first or the second exhaust path to provide series of parallel vacuum suction operation.

7. A vacuum cleaning machine comprising:

a base including both an aqueous solution system which is adapted for dispensing liquid under pressure and a recovery tank which is adapted for connection to an applicator tool for picking up water and debris; and a vacuum head which is mounted on the base and which includes a vacuum suction generating system therein coupled to the recovery tank for applying vacuum suction to the applicator tool via the recovery tank; the vacuum head comprising inner and outer shells (1) forming a mounting chamber for the vacuum system and (2) defining a vacuum air flow exhaust channel therebetween containing a sharply-angled bend, said vacuum exhaust channel having an increasing transverse cross-sectional area along the direction of exhaust, for exhausting the vacuum system and (3) forming inlet and outlet channels separate from the vacuum exhaust channel for supplying cooling air to the vacuum system;

said vacuum suction generating system including a pair of vacuum motor units interconnected between the recovery tank and the vacuum exhaust channel for providing selectable parallel or series vacuum suction operation.

8. A vacuum cleaning machine comprising:

a base including both an aqueous solution system which is adapted for dispensing liquid under pressure and a recovery tank which is adapted for connection to an applicator tool for picking up water and debris; and a vacuum head which is mounted on the base and which includes a vacuum suction generating system therein coupled to the recovery tank for applying vacuum suction to the applicator tool via the recovery tank; the vacuum head comprising inner and outer shells (1) forming a mounting chamber for the vacuum system and (2) defining a vacuum air flow exhaust channel therebetween containing a sharply-angled bend, said vacuum exhaust channel having an increasing transverse cross-sectional area along the direction of exhaust, for exhausting the vacuum system and (3) forming inlet and outlet channels separate from the vacuum exhaust channel for supplying cooling air to the vacuum system;

said vacuum suction generating system including first and second vacuum motor units interconnected between the recovery tank and the vacuum exhaust channel, each vacuum motor unit having an inlet and an exhaust; the exhaust of the first vacuum motor unit defining a first exhaust air flow path coupled into the inlet of the second vacuum unit, and also defining a second exhaust air flow path; and, means for diverting the exhaust air flow of the first vacuum unit into the first or the second exhaust path to provide series or parallel vacuum suction operation.

* * * * *